United States Patent [19]

Del Fabro et al.

[11] Patent Number: 5,035,130

[45] Date of Patent: Jul. 30, 1991

[54] ANTIROTATION STRAIGHTENING MACHINE

[75] Inventors: Giorgio Del Fabro, Cassacco Fraz. Montegnacco; Marcello Del Fabro, Udine, both of Italy

[73] Assignee: M.E.P. Machine Elettroniche Piegatrici SpA, Italy

[21] Appl. No.: 386,769

[22] Filed: Jul. 31, 1989

Related U.S. Application Data

[62] Division of Ser. No. 125,005, Nov. 24, 1987, Pat. No. 4,876,873.

[30] Foreign Application Priority Data

| | | | |
|---|---|---|---|
| Nov. 26, 1986 | [IT] | Italy | 83445 A/86 |
| Aug. 21, 1987 | [IT] | Italy | 83441 A/87 |
| Oct. 6, 1987 | [IT] | Italy | 83467 A/87 |

[51] Int. Cl.[5] ..... B21F 1/02

[52] U.S. Cl. ..... 72/162; 72/164

[58] Field of Search ..... 72/164, 160, 162; 140/147, 139

[56] References Cited

U.S. PATENT DOCUMENTS

| | | | |
|---|---|---|---|
| 511,422 | 12/1893 | Haskin . | |
| 731,675 | 6/1903 | Borchardt . | |
| 2,084,746 | 6/1937 | Roberts . | |
| 2,092,840 | 9/1937 | Greene . | |
| 2,517,309 | 8/1950 | Heller . | |
| 2,567,770 | 9/1951 | Heller . | |
| 2,720,243 | 10/1955 | Siegerist . | |
| 3,326,025 | 6/1967 | Nishioka | 72/161 |
| 3,374,653 | 3/1968 | Ziegler | 72/161 |
| 3,427,848 | 2/1969 | Gay | 72/161 |
| 3,798,948 | 3/1974 | Fangmeier | 72/162 |

FOREIGN PATENT DOCUMENTS

| | | | |
|---|---|---|---|
| 194478 | 9/1985 | European Pat. Off. | 72/217 |
| 1054263 | 2/1954 | France | 72/161 |
| 1469905 | 1/1967 | France . | |
| 2138615 | 12/1974 | France . | |
| 713633 | 2/1970 | U.S.S.R. | 72/162 |
| 124574 | 3/1919 | United Kingdom . | |

*Primary Examiner*—Daniel C. Crane

*Attorney, Agent, or Firm*—Wegner, Cantor, Mueller & Player

[57] ABSTRACT

Antirotation method to straighten sections (11), such sections (11) having a solid or hollow cross section and possibly having externally a round or ribbed cross section, or ridges, or else TOR type helicoidal ribbing, or a three-lobed, cross-shaped or star-shaped cross section, etc., and being in the form of bars or coils in a wound bundle (12) and possibly comprising a lengthwise twist, the section (11) being guided by grooves (21) comprises in rolls (18) of processing assemblies (16-17-23) and being made to pass through a guide and prestraightener assembly (16) and through two straightening assemblies (17) before being rendered linear (20) and then finished by a finishing assembly (23), the section (11) being diverted during the straightening step along at least one S-shaped or Z-shaped half-loop (14) and remaining positioned substantially on one single plane until it reaches the finishing assembly (23).

18 Claims, 2 Drawing Sheets

ANTIROTATION STRAIGHTENING MACHINE

This application is a divisional of Ser. No. 125,005, filed Nov. 24, 1987, now U.S. Pat. No. 4,876,873, issued Oct. 31, 1989.

This invention concerns an antirotation method to straighten sections which have in particular, but not only, a cross section which is not homogeneous.

According to the invention such sections may consist of ribbed round bars, round bars having ridges, TOR type round bars with helicoidal ribs, three-lobed sections, cross-shaped or star-shaped sections, straight or twisted bars, etc.

The method can also be applied to sections, whether drawn or rolled, which have a natural geometric cross section and to tubes.

The invention will be applied advantageously to sections being unwound from wound bundles but can be applied also to sections in the form of bars.

The invention is employed advantageously in all cases where the sections tend to rotate about their axis during the straightening step owing to their geometric structure and/or to the method employed to produce them and/or coil them in bundles.

The invention is applied to the straightening of sections having a round or equivalent cross section and a diameter of between 4 mm. and 16 mm.

A further purpose of the invention is to embody an antirotation straightening machine suitable to straighten sections and employing the method of the invention.

It is known that sections, whether solid or in the form of a hollow tube and whether produced with a cold or a hot process, have their initial cross section altered progressively while they undergo gradually increasing distortions during the rolling step owing to wear of the rolling rolls or rings. The original conditions of the sections are restored only by replacement of the rolls or rolling rings.

It is also known that on the circumference of a section, whether solid or tubular, leaving a coiling machine there is induced a rotation which depends on the direction of rotation of the coiling machine. This circumferential rotation causes a twist in the product, the pitch of such twist being variable.

This twist is fixed in the product as soon as it has been coiled, and such fixing is more noticeable when the product has been coiled while still hot and its cooling takes place in such wound bundle.

Such twist remains or increases during uncoiling, depending on the system used to unwind the product from the bundle.

In a round bar, for instance for building work, lengthwise ribs are produced during rolling and lie on a straight plane passing in the neighbourhood of the axis of the round bar. After being coiled, the round bar comprises ribs lying on a plane the development of which is helicoidal and passes in the neighbourhood of the axis of the round bar.

It is also known that in a section, whether it is solid or has a hollow core, non-homogeneous forces may appear which impart an auxiliary twist to the axis of the product. This auxiliary twist may affect only some segments of the section and will be added algebraically to the twists due to the coiling and unwinding.

Such twists together with the non-homogeneous cross section of the product induce in the product during straightening a reaction which is not constant, together with a movement of rotation of the product itself about its own axis. Such discontinuous movement of the product about its own axis during the straightening step does not possess a constant direction or intensity along the whole length of the product.

Such lack of structural continuity has the effect that with the methods used at present the product is never straightened satisfactorily.

Moreover, when such straightened product is employed to produce given required geometric shapes, for instance shaped bars for building work, it is unlikely that such required geometric shapes can be produced in a form like or the same as the theoretical geometric shape owing to the tensions which remain in the product and which the straightening has neither eliminated nor fixed.

Manifold systems have been proposed to obviate the shortcomings described above.

U.S. Pat. No. 299,615 discloses a plurality of rolls arranged in a spiral and performing the straightening function; the assembly of these rolls rotates about the imaginary axis of the wire. This system may be satisfactory for processing wire but is not such as will prevent rotation of the product about its own axis, nor is it suitable to process a very wide range of sections.

U.S. Pat. No. 731,675 discloses a straightening machine which straightens T-sections or angle bars, starting with bars. This invention not only deals with a product with which our present invention is not concerned, but also discloses a plurality of rolls positioned at an angle to each other and processing a section which is kept substantially straight.

GB 124,574 discloses a straightening machine with sleeves able to rotate about the axis of the product to be straightened and positioned as required in a rotary support tube. This invention may be workable where rod is to be straightened at relatively low speeds, but becomes unfit for use when it is necessary to straighten sections of the type indicated in the foregoing preamble.

U.S. Pat. No. 2,084,746 discloses a straightening machine employing rotary fliers to guide the sections better. This system entails the same limits as U.S. Pat. No. 299,615.

U.S. Pat. No. 2,720,243 discloses a straightening machine for sections which can process only those products that have a geometric shape which offers a secure guide for the rolls.

U.S. Pat. No. 3,068,931 discloses a straightening machine with rotary mandrels which is unsuitable to process sections and to process products already containing substantial twists.

FR 1.469.905 discloses the straightening of profiled bodies by means of a system of rotary sleeves. So as to do so, it provides straightening means which in one segment of the straightening machine are positioned so as to impart a circular or ovalized development. This system may be suitable for tubular or solid bodies having a square or rectangular cross section which are already substantially straight and do not contain induced twists.

FR 2,138,615 discloses a plurality of roll assemblies positioned at the vertices of a plurality of triangles rotated in relation to each other. This method does not enable sections of the type detailed in the foregoing preamble to be prevented from rotating about their axis.

EP-A-86102121.0 in the name of the present applicant discloses a plurality of straightening assemblies positioned at an angle to one another and located on more than one plane. This system ensures non-rotation of the section about its own axis but is very costly and hard to embody and regulate and also takes up a great deal of space. Moreover, although it prevents rotation, it does not provide a good or constant quality of straightening.

To prevent rotation of the section about its own axis during straightening, it is also possible to employ a drafting system with two pairs of tongs, so that one pair is always engaged and prevents rotation of the section. This system is very slow and does not ensure proper handling of the various types of sections cited in the foregoing preamble.

So as to obtain a straightening method in which a section of the type described will not rotate about its axis during or after the straightening, the present applicant has studied, tested and obtained a method according to the invention and a device which employs the method.

It is therefore a purpose of the invention to obtain with rotatable rolls the straightening of sections having a round or equivalent cross section with a diameter of between 4 mm. and 16 mm., whether solid or hollow, such as round bars, round ribbed bars, round bars with ridges, TOR type round bars with helicoidal ribs, three-lobed sections, cross-shaped or star-shaped sections, straight or twisted bars, etc., without such products having to rotate about their axis and without their inner and outer structures having to undergo modifications such as occur, for instance, where straightening is performed by revolving in sleeves.

A further purpose of this invention is to be able to straighten, with the same apparatus, sections having cross sections shaped with a plurality of different geometric figures having different circumferential positionings.

Yet another purpose of the invention is to improve the drafting of the sections during the straightening process.

Another purpose is to obtain the straightening of the sections in all their angular positions even if the section has lengthwise, along the plane passing through its centre and through the particular angular position, a geometric configuration differentiated along that plane.

Another purpose is to give the product an initial prestraightening before the actual straightening process.

A further purpose is to give the straightened product a finishing processing in an orthogonal direction.

Again, a purpose of the invention is to embody a device lying substantially wholly on the same plane until the straightening process is reached.

According to the invention at least one half-loop radiused with a desired and controlled development is imparted to the prestraightened section.

According to the invention a least one drafting unit is provided advantageously and is positioned substantially at the vertex of the half-loop.

According to a variant a second drafting unit is positioned upstream of the half-loop.

According to another variant the drafting units are positioned in the ascending segment of the first half-loop and in the descending segment of a second half-loop if included.

According to a further variant the straightening assemblies working on the half-loop of the section are at least partially driven assemblies so that they can perform the drafting function too.

Combinations of the above variants form part of the possible embodiments of the invention.

According to the invention there are imparted to the prestraightened section the forces and resulting deformations suitable to obtain straightening during its required sinuous path lying substantially on one single plane.

The forces necessary to straighten the product uniformly and to give it a finishing process, that is, to provide it with a linear form free of defects, are applied at the end of the sinuous segment. The finishing forces are applied at an angle to the plane on which the section lies.

The invention is also embodied with an antirotation straightening machine for sections which employs the above method.

The attached figures, which are given as a non-restrictive example, show the following:

Figure 2:
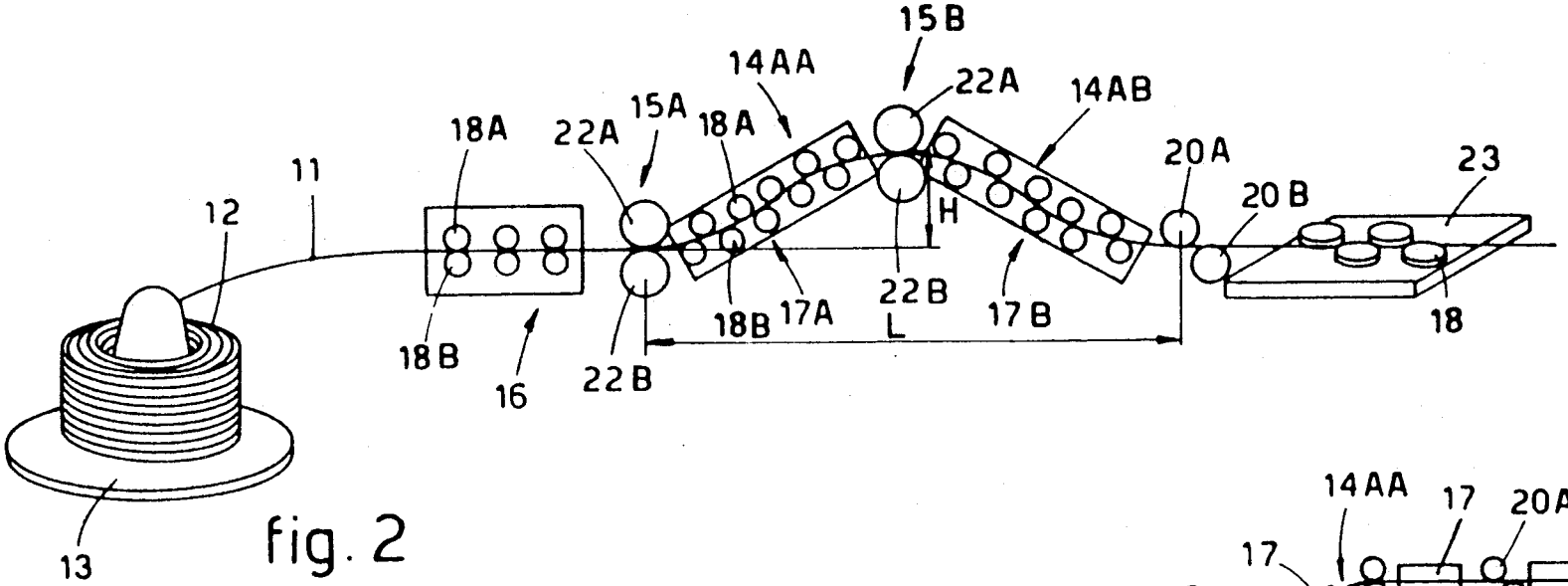
FIG. 2 shows a variant of the embodiment of FIG. 1.
Figure 6A:
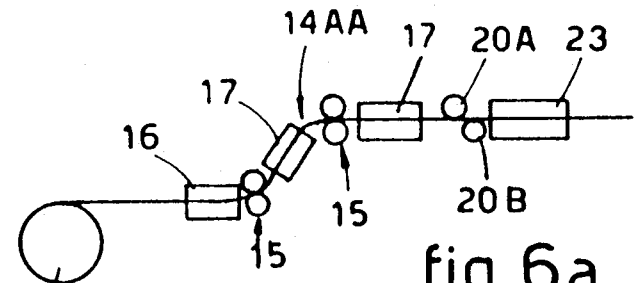
Figure 6B:
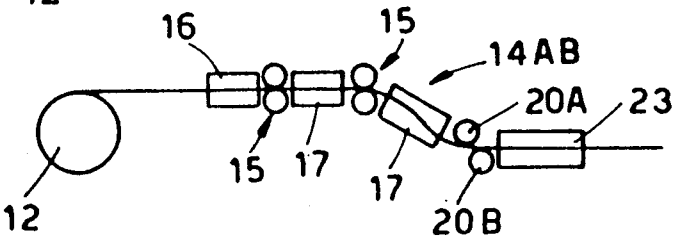

FIGS. 6*a* and 6*b* show two variants of the embodiment of FIG. 2.

The invention is shown as being applied to a section 11 being unwound from a wound bundle 12 located on a rotary support 13 of a known type.

The invention can be applied also to sections 11 in the form of bars and to sections 11 being unwound from above from a stationary or substantially stationary coiled bundle 12.

During the coiling step a twist may have been imparted to the section 11 and have made the development of the lengthwise fibres spiral and therefore also spiral any ribs which during the rolling step and, more generally, during the preparation were substantially parallel to the axis of the product.

As the section 11 is unwound from the bundle 12 or reel, its spiral development remains or is accentuated, depending on the method of unwinding.

Figure 1:
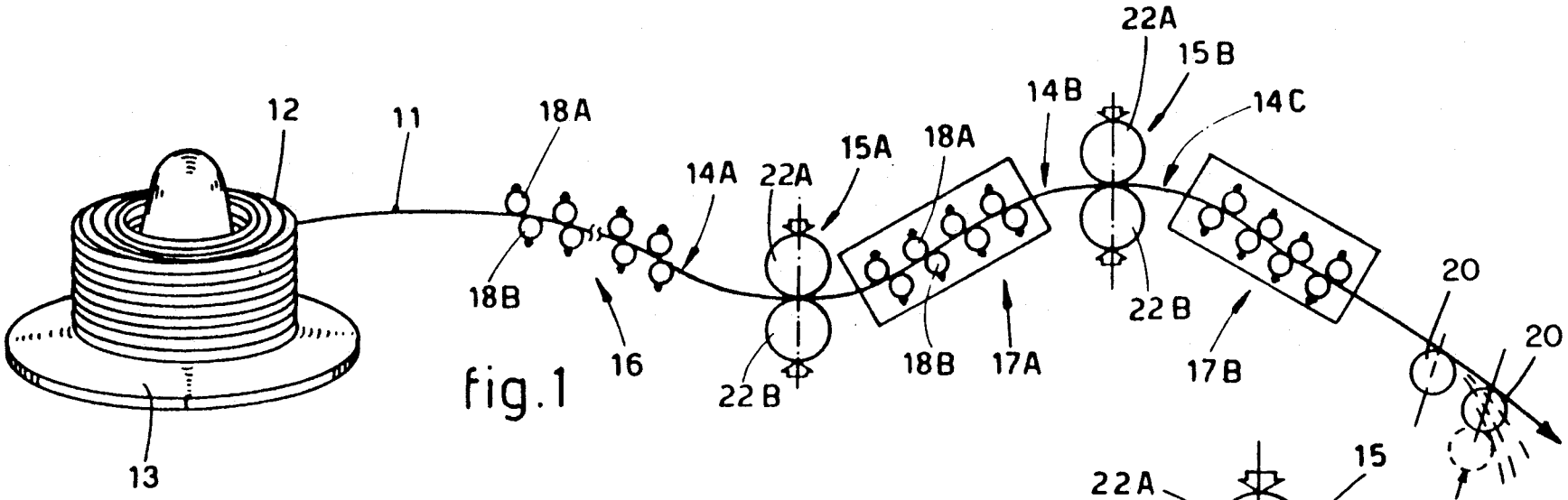
FIG. 1 shows a machine to straighten sections according to the invention.

According to the embodiment of FIG. 1 the section 11 is made to pass firstly into a half-loop 14A, then into an inverted half-loop 14B and lastly into a half-loop 14C in the same direction as the first half-loop 14A.

In the embodiment of FIG. 1 the loops formed by two neighbouring half-loops 14 have a substantially circular development with its centre located in the neighbourhood of 19, the radius of revolution being substantially constant.

According to a variant the radius of revolution is different in the two loops.

According to a further variant the radius of revolution is constant in the neighbourhood of the low point of one loop and in the neighbourhood of the vertex of the other loop; the segments of the loops adjacent to the above two points may have different configurations, depending on the characteristics of the section being processed.

According to the invention each upper roll 18A and each lower opposed roll 18B of the straightening assemblies 17 and of a guide and prestraightener assembly 16 act with a radial action passing in the neighbourhood of the respective loop centre 19.

Figure 4:
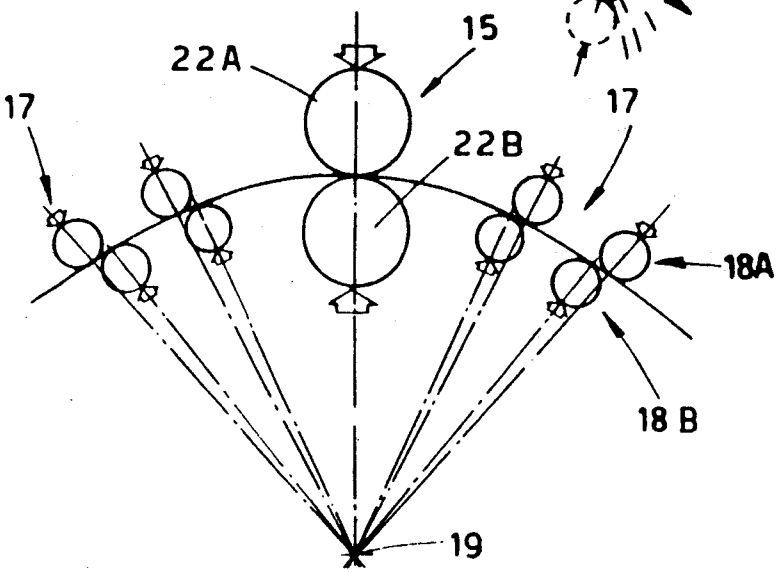
FIG. 4 shows the geometric position of the components of the embodiment of FIG. 1.

As shown in FIG. 4, the upper rolls 18A and lower opposed rolls 18B are not positioned face to face but are staggered by an extent necessary to ensure excellent engagement of the section along its whole path during the straightening.

According to the variant of FIG. 2 the section 11 is always made to pass firstly into a guide assembly 16 having the task of a prestraightener and comprising at least two pairs of rolls 18 but advantageously three pairs of rolls.

Next, the section 11 is made to pass into a radiused half-loop 14AA (FIG. 2 and FIG. 6*a*) and/or into an inverted radiused half-loop 14AB (FIG. 2 and FIG. 6*b*). Each half-loop 14 has a development rounded as an "S" or "Z", according to its positioning.

The second half-loop 14AB may be the counterpart of the first half-loop 14AA (see FIG. 2) or may be concordant therewith, that is to say, the half-loops 14 may be a continuation of each other.

According to the variant of FIG. 2 again, the loop formed by the two neighbouring half-loops 14AA and 14AB has a substantially circular development, apart from the curves joined to the straight tracts. This loop has substantially one single centre positioned in the neighbourhood of 19, or in a neighbourhood of centres 19, and the radius of revolution can be taken as being substantially constant.

According to the invention the range of dimensions provides for a radius of revolution of between 350 mm. and 1000 mm. but advantageously about 500 mm.

According to a variant the radius of revolution varies from one half-loop to the other.

A straightening assembly 17 cooperates with each half-loop 14 and has a curved mean development, thus imparting to the section 11 a sinuous development on the basis of its mean curved form.

The straightening assembly 17 advantageously receives the section 11 substantially at the beginning of a half-loop and delivers it substantially at the end of the half-loop.

Figure 5:
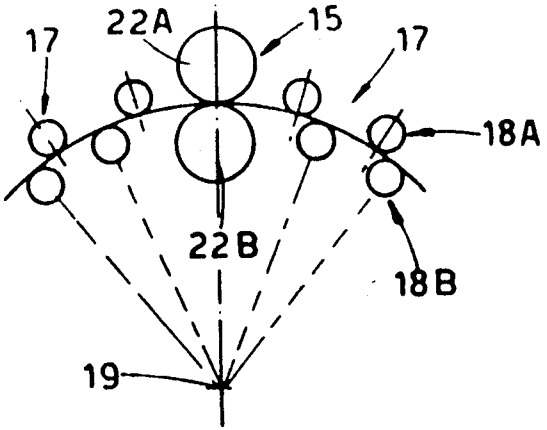
FIG. 5 shows the geometric position of the components of the embodiment of FIG. 2.

The position of the rolls 18 (FIG. 5) of the straightening assembly 17 is such that they cooperate in receipt and delivery of the section at the beginning and end of the half-loop 14.

Each pair of rolls 18 comprises upper rolls 18A and lower rolls 18B staggered in relation to each other by an extent suitable to ensure the required loosening effect on the section and the firm engagement of the section during the whole course of the straightening.

The rolls 18 of the initial and final pairs of rolls will be positioned advantageously in such a way that the first and last rolls 18 of each straightening assembly 17 cooperate with the respective initial and final curves of the half-loop 14.

The upper rolls 18A and lower opposed rolls 18B may be positionably immovable or be adjustable as regards their working position in relation to the section 11. Such adjustment may be performed on an individual roll, or on pairs of rolls and opposed rolls, or else on assemblies of pairs of rolls.

The upper rolls 18A or lower rolls 18B or both may be idler rolls or driven rolls.

The action of rolls 22 of drafting units 15 is applied along a radial position in relation to the respective centre 19 of the loop.

At least one drafting unit 15 is provided, but it has been found advantageous that a satisfactory number of units for an equivalent diameter range from 4 mm. to 16 mm. will be two drafting units 15 to reduce the specific force which each of them has to apply. The drafting rolls 22A and 22B are located face to face.

The drafting units 15 cooperate with respective straightening assemblies 17 and are positioned advantageously upstream thereof.

The rolls 18 of the straightening assemblies 17, the rolls 18 of the guide and prestraightener assembly 16, rolls 18 of a finishing assembly 23 and lastly also the rolls 22 of drafting units 15 comprise at least one containing groove 21. Advantageously at least two containing grooves 21 are comprised.

These containing grooves 21 enable each roll 22 or 18 to obtain at least two points of contact, with a resulting retaining and lateral fixture action such as to make unnecessary the inclusion of rolls positioned orthogonally. Such points of contact are positioned at an angle to each other, advantageously at 45° to each other under normal conditions.

The containing grooves 21 of the rolls 22 of the drafting units 15 are positioned face to face, with four nominal points of contact in the neighbourhood of the periphery lying on one single plane radial to the axis of the section 11; in this way they obtain containment conditions substantially able to provide very efficient drafting.

According to the variant of FIG. 2 the section 11 is made to pass firstly through a guide and prestraightener assembly 16, next through a first drafting unit 15A, then through a first straightening assembly 17A, a second drafting unit 15B and a second straightening assembly 17B.

At the outlet of the second straightening assembly 17B the section 11 is caused to cooperate with a roll 20A which makes the product linear, then with a positioning roll 20B and lastly is passed into a finishing assembly 23, which comprises pairs of staggered rolls lying on a plane substantially at a right angle to all the preceding part of the machine.

The guide and prestraightener assembly 16 is positioned on a segment of the path substantially at a tangent to the rolls of the first drafting unit 15A.

The first 15A and second 15B drafting units lie at the two vertices of the half-loops 14AA and 14AB in this example. The drafting units 15 may have one or both their rolls driven.

Each of the first 17A and second 17B straightening assemblies lies on and is consequently conformed by its respective contiguous half-loop 14.

According to a variant the straightening assemblies 17A and 17B comprise at least one pair of driven rolls so as to form drafting units too or to cooperate with the drafting units 17.

According to a further variant the straightening assemblies 17A and 17B are straightening and also drafting assemblies, while the units 15A and 15B are engagement and guide units.

Figure 3:
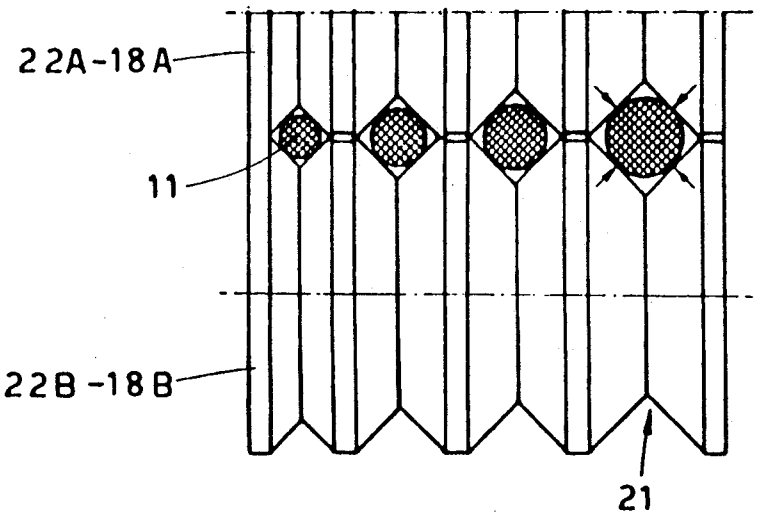
FIG. 3 shows a pair of drafting rolls according to the invention.

FIG. 3 shows an embodiment which provides for the use of a plurality of rolls 22A and opposed rolls 22B and/or 18A and 18B positioned side by side so as to straighten a plurality of sections 11 having different cross sections with one single machine.

The present applicant has found in practical tests that a straightening machine according to the embodiment of FIG. 2 of the invention, which should straighten sections 11 having an equivalent diameter ranging from 4 mm. to 16 mm., will have the following dimensional features.

The prestraightener assembly 16 and finishing assembly 23 will comprise three pairs and two pairs of rolls 18 respectively, and those rolls 18 may have a diameter of between 80 mm. and 150 mm., but advantageously a diameter of about 120 mm.

The drafting unit 15 will comprise rolls 22 having a diameter of between 140 mm. and 200 mm., but advantageously a diameter of about 170 mm.

The straightening assemblies 17 will comprise at least five pairs of rolls 18, but advantageously six pairs of rolls 18, and these rolls 18 will have a diameter of between 70 mm. and 120 mm., but advantageously a diameter of about 90 mm.

The distance L between the beginning of the first half-loop 14AA and the end of the second half-loop 14AB will be between 1100 mm. and 1700 mm., but advantageously will be about 1350 mm., while the height H of the half-loops will be between 80 mm. and 200 mm., but advantageously about 120 mm.

If the field of equivalent diameters is shifted or its extent is reduced, then the above values may vary, so that if the field is shifted to high or higher values, then the number of pairs of rolls 18 in the prestraightener assembly 16, straightening assemblies 17 and finishing assembly 23 may be increased or reduced or the diameter of such rolls may also or only be increased.

FIGS. *6a* and *6b* show two variants of the embodiment of FIG. 2, which comprise the same equipment. FIG. *6a* shows only the half-loop 14AA, whereas FIG. 6B shows only the half-loop 14AB.

We claim:

1. An antirotation straightening machine for elongated solid bar-shaped or elongated tubular sections, comprising, substantially on a single plane:

a guide and prestraightener assembly for initially straightening the elongated sections;

means for guiding the initially straightened elongated sections through at least two straightening assemblies, wherein each of the straightening assemblies includes multiple pairs of rollers, and each of the pairs of at least one of the straightening assemblies is in position such that a portion of the elongated sections travelling therethrough travels along a path forming an S- or Z-shaped half-loop so as to prevent rotation of the elongated sections about their axes while the sections are straightened, the multiple pairs of the at least one straightening assembly being arranged so that opposed rollers of each pair are staggered along the path;

a linearizing assembly for forming linear, straightened sections; and a finishing assembly for forming a finished, straightened section product, the path of the elongated sections through the guide and prestraightener assembly, the two straightening assemblies and the linearizing assembly being in a single plane throughout the operation of the machine.

2. A machine as claimed in claim 1, which comprises at least two drafting units, each of which cooperates with a respective straightening assembly and is positioned upstream of its respective straightening assembly.

3. A machine as claimed in claim 1, wherein the finishing assembly is positioned at a tangent to the assembly which renders the section linear, and lies on a plane positioned at a right angle to the plane on which the section lies in the assemblies positioned upstream.

4. A machine as claimed in claim 1, wherein at least one straightening assembly acts as a drafting unit.

5. A machine as claimed in claim 1, wherein at least one of said guide and prestraightener assembly, two straightening assemblies, and finishing assembly comprises pairs of rolls.

6. A machine as claimed in claim 1, comprising pairs of rolls staggered lengthwise in the straightening assemblies and finishing assembly.

7. A machine as claimed in claim 1, wherein the guide and prestraightener assembly comprises pairs of rolls, wherein said rolls are substantially facing each other.

8. A machine as claimed in claim 5, wherein at least some of the rolls act substantially in a radial direction.

9. A machine as claimed in claim 5, wherein the straightening assembly comprises rolls, and said rolls are in a stationary position when in their working position.

10. A machine as claimed in claim 5, wherein at least one roll in each assembly can be adjusted in its working position.

11. A machine as claimed in claim 7, wherein the radius of the half-loop in the neighborhood of the vertex and low point of the half-loop is between 350 mm. and 1000 mm.

12. A machine as claimed in claim 5, wherein the rolls of the guide and prestraightener assembly and of the finishing assembly have a diameter of between 80 mm. and 150 mm.

13. A machine as claimed in claim 1, wherein each assembly comprises pairs of rolls, and at least one pair of rolls in each assembly can be adjusted in its working position.

14. A machine as claimed in claim 5, wherein each roll of the processing assemblies comprises at least one groove to contain the section, said groove comprising at least two points of contact with the section, said points being at an angle to each other.

15. A machine as claimed in claim 4, wherein the straightening assembly acting as a drafting unit comprises rolls.

16. A machine as claimed in claim 13, where the rolls of the drafting units have a diameter of between 140 mm. and 200 mm.

17. A machine as claimed in claim 5, wherein the rolls of the straightening assemblies have a diameter of between 70 mm. and 120 mm.

18. A machine as claimed in claim 1, comprising two neighboring half-loops, one S-shaped and the other Z-shaped, having a length of between 1100 mm. and 1700 mm. and a height of between 80 mm. and 200 mm.

* * * * *